United States Patent [19]

Maul

[11] Patent Number: 4,629,275

[45] Date of Patent: Dec. 16, 1986

[54] STRAIN-RELIEF ADAPTER FOR A CABLE OR HARNESS

[75] Inventor: Fred Maul, Milpitas, Calif.

[73] Assignee: Raychem Corporation, Menlo Park, Calif.

[21] Appl. No.: 734,635

[22] Filed: May 15, 1985

[51] Int. Cl.[4] ..... H01R 13/56; H01R 13/58

[52] U.S. Cl. ..... 339/103 R; 174/DIG. 8; 339/101

[58] Field of Search ..... 339/101, 102 R, 103 R, 339/103 M, 104, DIG. 1; 174/DIG. 8

[56] References Cited

U.S. PATENT DOCUMENTS

| | | | |
|---|---|---|---|
| 3,851,296 | 11/1974 | Muchmore et al. | 339/DIG. 1 X |
| 4,195,106 | 3/1980 | Brusselmans | 174/DIG. 8 X |
| 4,500,371 | 2/1985 | De Groot | 174/DIG. 8 X |

OTHER PUBLICATIONS

"Templock Thinwall Shrink Tubing", advertisement, 1971.

*Primary Examiner*—Eugene F. Desmond
*Attorney, Agent, or Firm*—Ira David Blecker

[57] ABSTRACT

There is disclosed a strain-relief adapter for relieving strain between a cable or harness and a connector. The strain-relief adapter consists of a flexible, generally tubular body of braided nonmetallic filaments, attachment means on one end of the tubular body for attaching the tubular body to a connector and a blocking sleeve on the other end of the tubular body for attaching the tubular body to a cable or harness. The blocking sleeve includes a heat-shrinkable tube and an adhesive.

14 Claims, 6 Drawing Figures

STRAIN-RELIEF ADAPTER FOR A CABLE OR HARNESS

FIELD OF THE INVENTION

This invention relates to those arrangements suitable for strain-relieving the wire connection between a connector and a cable or harness.

BACKGROUND OF THE INVENTION

In the manufacture of open wire bundle cables, it is necessary to strain-relieve the wire connection between the connector and the cable so that when in use the cable itself may be pulled on, the cable or individual wires will not separate from the connector.

There are several devices available for performing the strain-relieving function. For example, one device is a saddle clamp which is attached by screwing down two metal bars against the wire bundle from opposite sides. Two problems are inherent in such a device. The first is that wires are sometimes pinched between the clamp and bars causing a break or short in the wire. The second is that the wires on the inside of the wire bundle are not really held in place and can be pulled out.

In the case of open wire bundle cables, it is extremely desirable that wires on the inside of the wire bundle be strain-relieved to the same extent as wires on the outside of the wire bundle.

Even in the case of jacketed cables or harnesses, it is desirable that the cable or harness be effectively strain-relieved without risk of damage to the cable or harness.

Strain relieving of cables having a visible gross electromagnetic interference (EMI) shield is not a problem as there are already suitable devices for performing this function. One device is a section of EMI shield which is placed over the cable. One end of the section of EMI shield is attached to the connector by a suitable means, such as a magnaformed ring, and the other end is attached to the cable by a short length of heat-recoverable material and solder-impregnated EMI shield. However, this device is only suitable for use with shielded cables. Further, while this device will strain-relieve a shielded cable, the main utility of the device is to maintain continuity of the shield between the shielded cable and the connector.

It is thus an object of the invention to have a strain-relieving arrangement suitable for use with cables and harnesses not having a visible gross EMI shield.

This and other objects of the invention will become more apparent after reference to the following description considered in conjunction with the accompanying drawings.

BRIEF SUMMARY OF THE INVENTION

According to the invention there is disclosed a strain-relief adapter comprising a flexible, generally tubular body of braided nonmetallic filaments, attachment means on one end of the tubular body and a blocking sleeve on the other end of the tubular body. The attachment means is for attaching the tubular body to a connector and the blocking sleeve is for attaching the tubular body to a cable or harness. The blocking sleeve comprises a heat-shrinkable tube and an adhesive.

DETAILED DESCRIPTION OF THE INVENTION

According to the invention there is disclosed a strain-relief adapter comprising a flexible, generally tubular body of braided nonmetallic filaments, attachment means on one end of the tubular body for attaching the tubular body to a connector and a blocking sleeve on the other end of the tubular body for attaching the tubular body to a cable or harness. The blocking sleeve comprises a heat-shrinkable tube and an adhesive.

Figure 1:
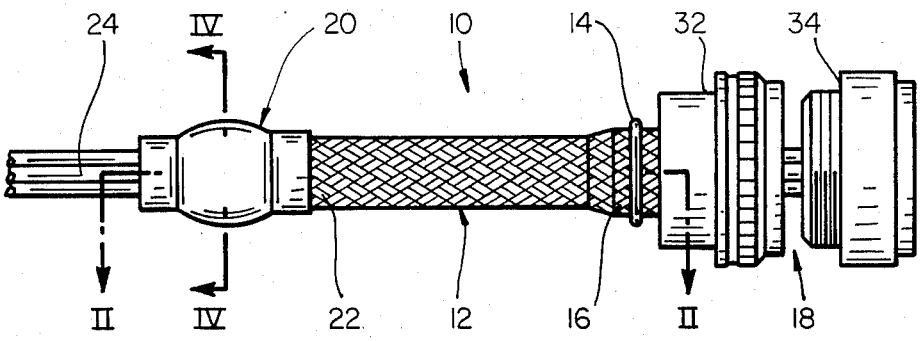
FIG. 1 is a side view of the strain-relief adapter according to the invention prior to recovery of the blocking sleeve.

Referring to the Figures in more detail and particularly referring to FIG. 1, the flexible, generally tubular body 12 can be seen. It is important to the invention that the tubular body be made from a nonmetallic material. At one end 16 of the tubular body there are attachment means generally indicated by 14. The attachment means attaches the tubular body to a connector generally indicated by 18. On the other end 22 of the tubular body there is a blocking sleeve generally indicated by 20 for attaching the tubular body to a cable or harness 24.

The connector 18 may be a spin coupling adapter 32 as shown in the figures or it may be any other suitable connector. The spin coupling adapter itself engages a connector body 34 in which the wires or cables are actually terminated. Together, the spin coupling adapter and the connector body form a complete termination device. Under certain circumstances, the spin coupling adapter may be omitted and the strain-relief adapter may be attached directly to the connector. For purposes of this specification, spin coupling adapters and connectors should both be considered to be connectors. Throughout the remainder of this specification, only the spin coupling adapter will be referred to as it relates to the preferred mode of the invention. It should be understood, however, that attachment of the strain-relief adapter directly to a connector (other than a spin coupling adapter) is also contemplated within the scope of the invention.

The strain-relief adapter of the invention is anticipated to have greatest applicability to open wire bundle cables as there is no commercial device currently available that performs in an entirely satisfactory manner. However, it is also anticipated that the strain-relief adapter will find use with jacketed cables and harnesses.

Figure 2:
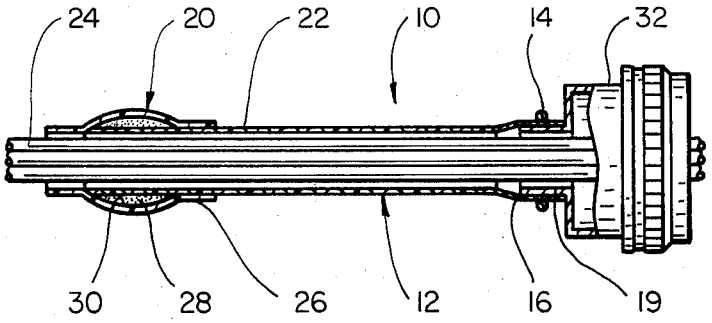
FIG. 2 is a sectional view taken along the lines II—II of FIG. 1.

As can be seen more clearly in FIG. 2, the blocking sleeve includes a heat-shrinkable tube 26 having an adhesive 28 along the inside surface 30 of the heat-shrinkable tube. The adhesive may be located substantially along the entire inside surface of the heat-shrinkable tube. However, it is most important that the adhesive-coated inside surface include the area where the heat-shrinkable tube contacts the generally tubular body. As shown in FIGS. 1 and 2, the heat-shrinkable tube is in its pre-recovery state.

Heat-shrinkable materials, in general, are well-known although not with respect to the instant invention. It is preferred that the heat-shrinkable tube be made of a polymeric material which is capable of resisting elevated temperatures for the time needed to melt and flow the adhesive. Suitable materials include, for example and not by way of limitation, polyolefins such as polyethylene, polypropylene, and polyvinylidene fluoride. These polymeric materials may be crosslinked by chemicals or by radiation.

The adhesive may be selected from the group consisting of hot-melt adhesives and epoxy resins. There are many hot-melt adhesives well-known to those skilled in the art which will perform the objects of the invention. However, a particularly preferred adhesive is an ethylene vinyl acetate-polyimide blend.

Figure 3:
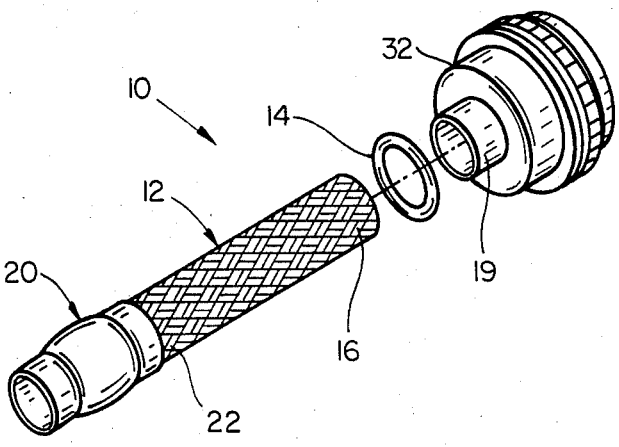
FIG. 3 is an exploded view of the strain-relief adapter according to the invention prior to assembly.

Referring now to FIG. 3, the strain relief adapter can be seen prior to assembly. The flexible, generally tubular body 12 has the blocking sleeve generally indicated by 20 on one end 22 of the tubular body. An attachment means generally indicated by 14 is ready for sliding onto end 16 of the tubular body. Attachment means 14 is slightly larger in diameter than end 16 of the tubular body so that it will easily slide over the tubular body. This facilitates the assembly of the adapter. End 16 of the tubular body is then placed on portion 19 of spin coupling adapter 32. Then attachment means 14 is positioned so as to be directly over end 16 of the tubular body and portion 19 of the spin coupling adapter. Finally, a mechanical joint is formed between attachment means 14 and portion 19, as discussed hereafter. Once assembled, the strain-relief adapter 10 will appear as in FIG. 1. Again the blocking sleeve has not yet recovered so that it is able to accept a cable or harness.

Figure 4:
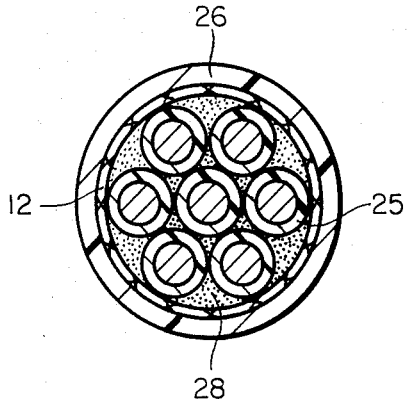
FIG. 4 is a cross-sectional view along the lines IV—IV of FIG. 1 but after recovery of the blocking sleeve.

After the cable or harness is inserted into the strain-relief adapter so that it protrudes all the way through the blocking sleeve and past the spin coupling adapter 32 to the connector body 34, then heat is applied to the blocking sleeve to cause recovery of the heat-shrinkable tube 26 and the flowing of adhesive 28. Referring now to FIG. 4, which shows a cross-section of the blocking sleeve after recovery, it can be seen that the adhesive 28 has entirely penetrated throughout and among all the individual cables or wires 25. The flowing of the adhesive and recovery of the heat-shrinkable tube 26 provides a firm grip on the tubular body and the cable or harness. Since end 16 of the tubular body is firmly attached to spin coupling adapter 32 which engages connector body 34, 18 the connection between the cable or harness and the connector has been effectively strain-relieved.

The attachment means generally indicated by 14 may be any of several means. The attachment means may be a shape-memory alloy ring such as that disclosed in U.S. Pat. No. 3,990,765 and incorporated herein by reference which would recover upon exposure to a heat source. The shape-memory alloy may be a copper-based shape-memory alloy or a titanium/nickel-based shape-memory alloy, either of which alloys are well-known to those skilled in the art. Particularly preferred shape-memory alloys are the cryogenic nickel/titanium/iron alloys of U.S. Pat. No. 3,753,700 and the nickel/titanium/niobium alloys of U.S. patent application Ser. No. 668,777 (filed Nov. 6, 1984) processed according to U.S. patent application Ser. No. 668,771 (filed Nov. 6, 1984), all of which are incorporated herein by reference. The attachment means may also comprise a magnaformed ring, the processing of magnaforming, of course, being well known to those skilled in the art. Alternatively, the attachment means may simply comprise a tying device such as commercially available nylon tie-wraps.

It is important to the invention that the flexible, generally tubular body be made of braided nonmetallic filaments. The fact that the filaments are braided provides support and the fact that the filaments are nonmetallic makes this adapter suitable for a number of applications. If the filaments were metallic then upon recovery of the blocking sleeve, the metallic ends of the braid would dig into the cable and possibly short out the cable which would be extremely undesirable.

Suitable nonmetallic filaments for the tubular body include but are not limited to HALAR ® (HALAR ®, a product of Allied Corporation, is a co-polymer of ethylene and chlorotrifluoroethylene), KEVLAR ®, (KEVLAR, a product of E. I. DuPont de Nemours & Co., is an aramid fiber and generically describes a family of aromatic polyamides), polyester, polypropylene, polyethylene, and nylon. The more preferred nonmetallic filaments are HALAR, polyester, and KEVLAR and of these, HALAR and polyester are the most preferred. It is also within the scope of the invention for the filaments to be heat-recoverable.

Figure 5:
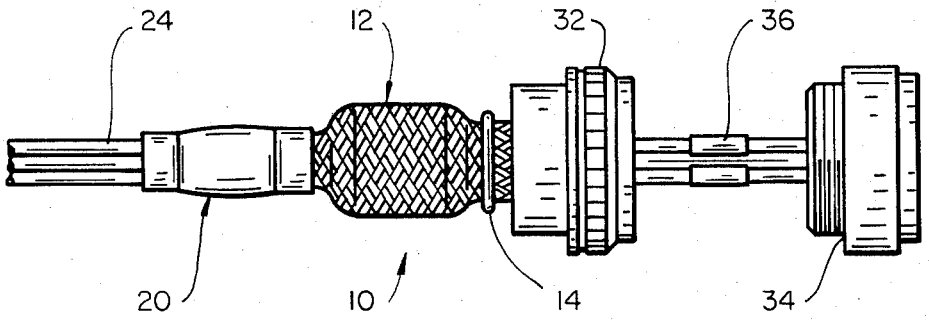
FIG. 5 is a side view of the strain-relief adapter according to the invention showing a particular advantage of the invention.

FIG. 5 illustrates a particular advantage of the invention. After the strain-relief adapter is fully deployed, that is, after recovery of the blocking sleeve 20 and attachment of the spin coupling adapter 32 to connector body 34, it may be necessary at some time in the future to check wire splices 36. In this case, all that need be done is to disengage the spin coupling adapter from the connector body and then push back the spin coupling adapter, as shown in FIG. 5. When the strain-relief adapter is in this pushed-back configuration, wire splices 36 can be easily inspected. It should also be noted that when the strain-relief adapter is again fully deployed, the tubular body will provide protection for these same wire splices.

Figure 6:
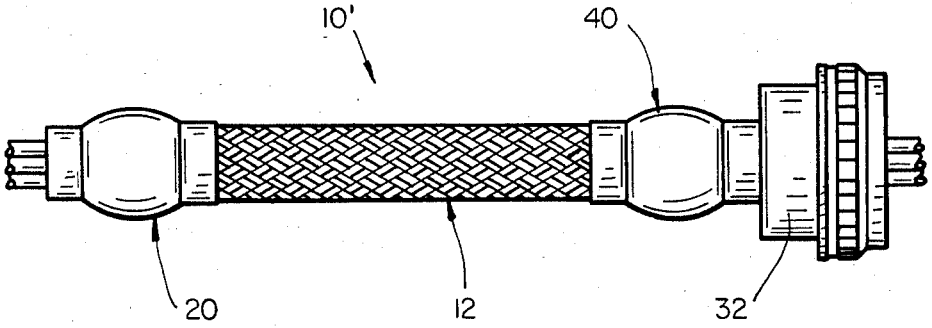
FIG. 6 is a modification of the strain-relief adapter of FIG. 1.

Referring now to FIG. 6 there is shown a modification of the strain-relief adapter of FIG. 1. In this embodiment the strain-relief adapter 10' is essentially similar to the strain-relief adapter of FIG. 1 except the attachment means is somewhat different. In FIG. 6 the attachment means is a blocking sleeve generally indicated by 40 which comprises a heat-shrinkable tube and an adhesive. It can thus be appreciated that the blocking sleeve 40 is essentially identical to the blocking sleeve 20.

The previously described embodiments of the invention have claimed a strain-relief adapter comprising a flexible, generally tubular body of braided nonmetallic filaments, attachment means on one end of the tubular body and a blocking sleeve on the other end of the tubular body. Now there is described a further embodiment of the invention.

According to the invention there is further disclosed a strain-relief adapter comprising a spin-coupling adapter, a flexible, generally tubular body of braided nonmetallic filaments, attachment means on one end of the tubular body for attaching the tubular body to the adapter, and a blocking sleeve on the other end of the tubular body for attaching the tubular body to a cable or harness. The blocking sleeve comprises a heat-shrinkable tube and an adhesive.

It can thus be appreciated that in this last-mentioned embodiment of the invention now included as part of the invention is the spin coupling adapter shown in FIGS. 1, 2, 3, 5 and 6. In all other respects, this embodiment of the invention is similar to the embodiments of the invention discussed above.

Thus it can be appreciated that while the invention generally relates to strain-relief adapters joined to connectors, the invention more specifically relates to strain-relief adapters in which there is a spin-coupling adapter.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

I claim:

1. Strain-relief adapter comprising:

a flexible, generally tubular body of braided nonmetallic filaments;

attachment means on one end of said tubular body for attaching said tubular body to a connector; and a blocking sleeve on the other end of said tubular body for attaching said tubular body to a cable or harness, said blocking sleeve comprising a heat-shrinkable tube and an adhesive;

wherein said tubular body having a central portion, consisting only of said tubular body, extending between said attachment means and said blocking sleeve, said tubular body central portion providing strain relief and abrasion protection for a cable or harness.

2. The strain-relief adapter of claim 1 wherein said adhesive is selected from the group consisting of hot-melt adhesives and epoxy resins.

3. The strain-relief adapter of claim 1 wherein said attachment means is a blocking sleeve comprising a heat-shrinkable tube and an adhesive.

4. The strain-relief adapter of claim 3 wherein said adhesive is selected from the group consisting of hot-melt adhesives and epoxy resins.

5. The strain-relief adapter of claim 1 wherein said attachment means comprises a shape-memory alloy ring.

6. The strain relief adapter of claim 1 wherein said attachment means comprises a magnaformed ring.

7. The strain-relief adapter of claim 1 wherein the braided nonmetallic filaments of said tubular body are selected from the group consisting of polyesters, aramid fibers, and copolymers of ethylene and chlorotrifluorothylene.

8. Strain-relief adapter comprising:

a spin-coupling adapter;

a flexible, generally tubular body of braided nonmetallic filaments;

attachment means on one end of said tubular body for attaching said tubular body to said adapter;

a blocking sleeve on the other end of said tubular body for attaching said tubular body to a cable or harness, said tubular blocking sleeve comprising a heat-shrinkable tube and an adhesive;

wherein said tubular body having a central portion, consisting only of said tubular body, extending between said attachment means and said blocking sleeve, said tubular body central portion providing strain relief and abrasion protection for a cable harness.

9. The strain-relief adapter of claim 8 wherein said adhesive is selected from the group consisting of hot-melt adhesive and epoxy resins.

10. The strain-relief adapter of claim 8 wherein said attachment means is a blocking sleeve comprising a heat-shrinkable tube and an adhesive.

11. The strain-relief adapter of claim 10 wherein said adhesive is selected from the group consisting of hot-melt adhesives and epoxy resins.

12. The strain-relief adapter of claim 8 wherein said attachment means comprises a shape-memory alloy ring.

13. The strain-relief adapter of claim 8 wherein said attachment means comprises a magnaformed ring.

14. The strain-relief adapter of claim 8 wherein the braided nonmetallic filaments of said tubular body are selected from the group consisting of polyesters, aramid fibers and copolymers of ethylene and chlorotrifluorothylene.

* * * * *